US008545180B1

(12) United States Patent
Liang

(10) Patent No.: US 8,545,180 B1
(45) Date of Patent: Oct. 1, 2013

(54) TURBINE BLADE WITH SHOWERHEAD FILM COOLING HOLES

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 408 days.

(21) Appl. No.: 13/032,973

(22) Filed: Feb. 23, 2011

(51) Int. Cl.
*F01D 5/18* (2006.01)

(52) U.S. Cl.
USPC ..... 416/97 R; 416/232; 415/115

(58) Field of Classification Search
USPC ..... 415/115; 416/97 R, 95, 96 R, 232
See application file for complete search history.

(56) References Cited

U.S. PATENT DOCUMENTS

| | | | | |
|---|---|---|---|---|
| 6,036,436 | A * | 3/2000 | Fukuno et al. | 415/115 |
| 6,419,449 | B2 * | 7/2002 | Ferber | 416/96 A |
| 2006/0002796 | A1 * | 1/2006 | Bolms et al. | 416/97 R |
| 2008/0286116 | A1 * | 11/2008 | Ireland et al. | 416/97 R |

* cited by examiner

*Primary Examiner* — Nathaniel Wiehe
*Assistant Examiner* — Aaron Jagoda
(74) *Attorney, Agent, or Firm* — John Ryznic

(57) ABSTRACT

A turbine rotor blade with a showerhead arrangement of film cooling holes arranged in three zones with a lower span zone and a middle spa zone and an upper span zone. The film cooling holes in the lower zone have a greater ejection angle than the film holes in the middle span zone, and the middle span zone film holes have a greater ejection angle than the film holes in the upper span zone.

3 Claims, 4 Drawing Sheets view A-A
prior art view B-B
prior art

TURBINE BLADE WITH SHOWERHEAD FILM COOLING HOLES

GOVERNMENT LICENSE RIGHTS

None.

CROSS-REFERENCE TO RELATED APPLICATIONS

None.

BACKGROUND OF THE INVENTION

1. Field of the Invention

The present invention relates generally to gas turbine engine, and more specifically for an air cooled turbine blade with showerhead film cooling holes for cooling a leading edge surface.

2. Description of the Related Art Including Information Disclosed Under 37 CFR 1.97 and 1.98

In a gas turbine engine, such as a large frame heavy-duty industrial gas turbine (IGT) engine, a hot gas stream generated in a combustor is passed through a turbine to produce mechanical work. The turbine includes one or more rows or stages of stator vanes and rotor blades that react with the hot gas stream in a progressively decreasing temperature. The efficiency of the turbine—and therefore the engine—can be increased by passing a higher temperature gas stream into the turbine. However, the turbine inlet temperature is limited to the material properties of the turbine, especially the first stage vanes and blades, and an amount of cooling capability for these first stage airfoils.

The first stage rotor blade and stator vanes are exposed to the highest gas stream temperatures, with the temperature gradually decreasing as the gas stream passes through the turbine stages. The first and second stage airfoils (blades and vanes) must be cooled by passing cooling air through internal cooling passages and discharging the cooling air through film cooling holes to provide a blanket layer of cooling air to protect the hot metal surface from the hot gas stream.

To cool the leading edge region of a rotor blade or a stator vane, an arrangement of film cooling holes and gill holes are used. Rotor blades differ from stator vanes in that the rotor blade is rotating which effects the ejection of any cooling air from the holes. FIG. 1 shows a cross section view of a leading edge (L/E) region of a rotor blade with three film cooling holes 11 located in the leading edge and two gill holes located on the pressure side (P/S) and the suction side (S/S) of the L/E film cooling holes. The middle film cooling hole is located at a stagnation line which is where the hot gas stream strikes the airfoil at 90 degrees to the surface. The other two film cooling holes are located adjacent to and on the P/S and the S/S of the stagnation film cooling hole. This arrangement is formed along the entire airfoil surface from the platform to the blade tip. The film holes 11 and the gill holes 12 are supplied with cooling air from a cooling air supply channel 13 through a row of metering and impingement holes 14 that open into a leading edge impingement cavity 15. The L/E impingement cavity 15 can be formed from one long cavity or several cavities that form individual and separated compartments for the purpose of customizing to cooling air flow and pressure into the respective cavity depending upon the heat load and external gas pressure along the L/E of the airfoil. FIG. 2 shows a cross section view of the entire blade with the L/E cooling circuit described in FIG. 1.

FIG. 3 shows a cross section side view of the film cooling hole 11 along the stagnation line through the line A-A in FIG. 1. The three rows of film cooling holes on the L/E are inclined at around 20 to 30 degrees from the L/E airfoil surface and towards the blade tip. FIG. 4 shows a front view of the L/E film cooling holes with the stagnation row in the middle and the P/S row on the right and the S/S row on the left. The main problem with this L/E film cooling hole design is the overlapping of film cooling ejection flow in a rotational environment of the rotor blade and a lacking of film coverage for the blade L/E region. As seen in FIG. 4, film cooling air ejected from the middle row does not cover the entire surface around the P/S or S/S rows. There are areas that are not covered with a layer of film cooling air. As a result of this lack of full coverage, a hot streak is developed between film holes.

One disadvantage of the showerhead arrangement of the prior art of FIG. 4 is the use of film cooling holes with a constant spanwise angle without tailoring to the leading edge region heat load as well as mechanical loads. As a result of the prior art film cooling, an over-cooling occurs at the blade lower span and/or an over-stress occurs at the blade root section if a low surface angle cooling hole is used, such as a 20 degree angle film hole to the airfoil surface. If a high surface angle hole is used, such as a 35 degree film hole, then an under-cooling of the leading edge will occur in the high heat load region of the airfoil leading edge. FIG. 3 shows a graph of the blade heat load and FIG. 4 shows a graph of the mechanical loads on the blade leading edge region.

BRIEF SUMMARY OF THE INVENTION

An air cooled turbine rotor blade with a showerhead arrangement of film cooling holes for the leading edge surface in which the film cooling holes in the blade lower span have angles of around 30 degrees, the film cooling holes in the blade mid-span have angles of around 25 degrees, and the film cooling holes in the blade upper span have angles of around 20 degrees.

DETAILED DESCRIPTION OF THE INVENTION

Figure 1:
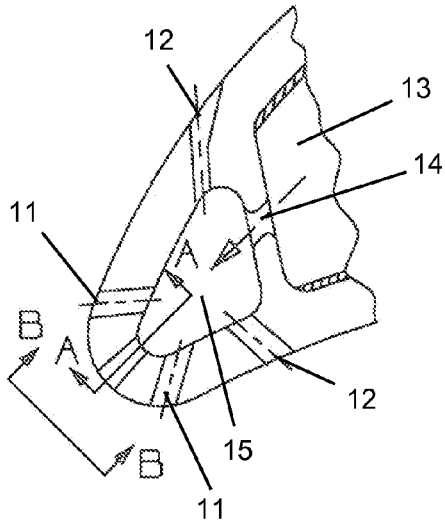
FIG 1 prior art
FIG. 1 shows a cross section view of a showerhead film cooling hole design for a prior art turbine rotor blade.
Figure 2:
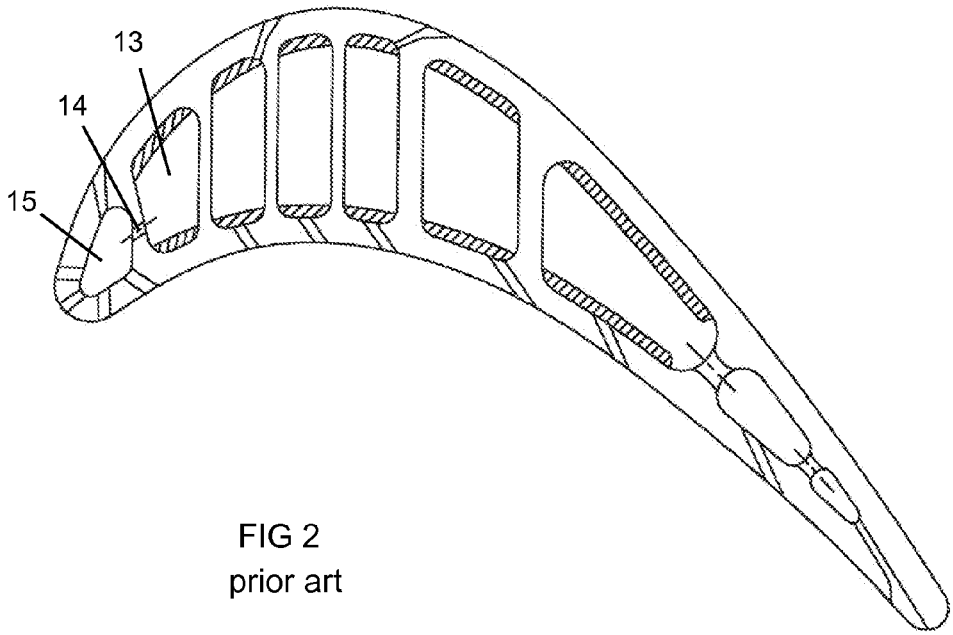
FIG 2 prior art
FIG. 2 shows a cross section view of a turbine rotor blade cooling circuit of the prior art with the showerhead film cooling design of FIG. 1.
Figure 3:
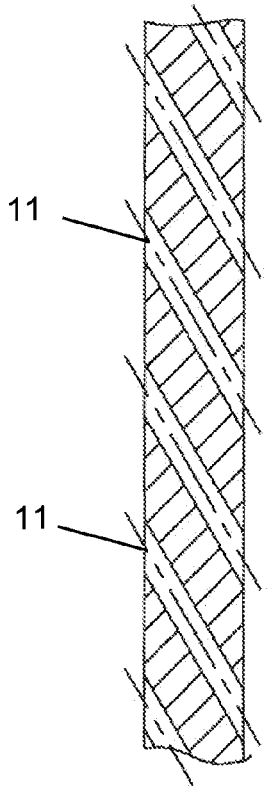
FIG. 3 shows a cross section side view of a film cooling hole through line A-A in FIG. 1.
Figure 4:
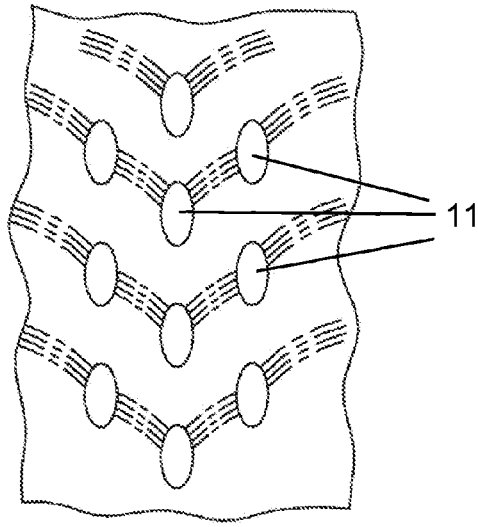
FIG. 4 shows a front view of the showerhead film cooling hole arrangement of FIG. 1 through the line B-B.
Figure 5:
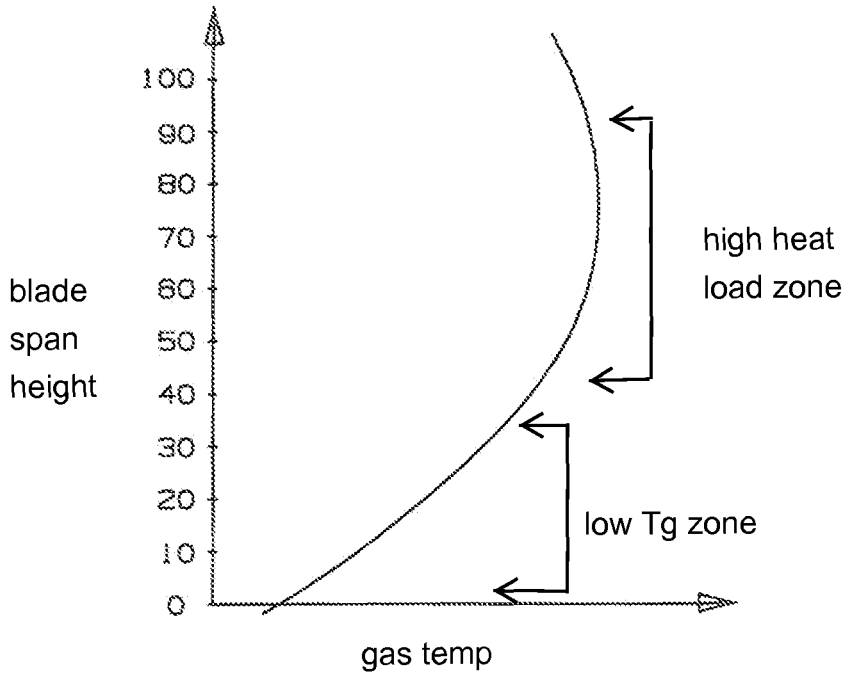
FIG. 5 shows a graph of the blade leading edge region heat load for the blade span height versus the gas temperature.
Figure 6:
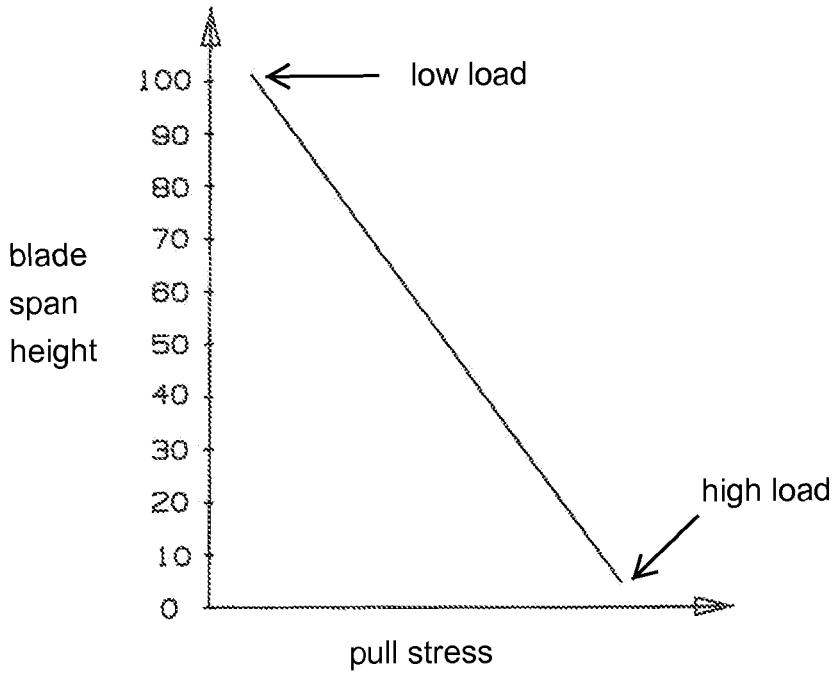
FIG. 6 shows a graph of the blade leading edge region mechanical load for the blade span height versus the pull stress.
Figure 7:
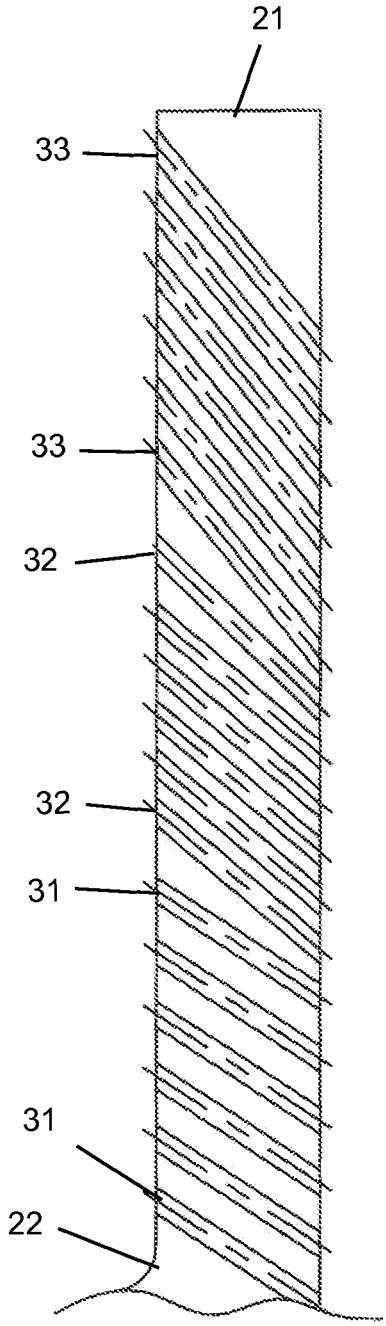
FIG. 7 shows a cross section view of the blade leading edge with film cooling holes for the present invention.
Figure 8:
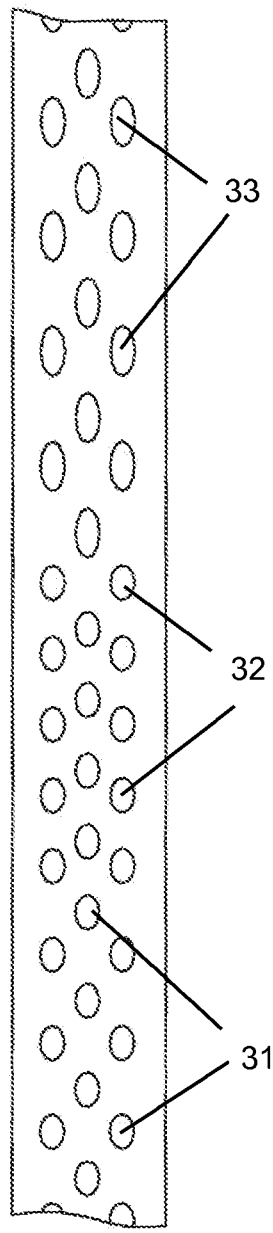
FIG. 8 shows a front view of the blade leading edge with the film cooling holes of the present invention.

A turbine rotor blade, especially for use in a large frame heavy duty industrial gas turbine engine, with a showerhead arrangement of film cooling holes for the leading edge region. FIG. 5 shows a side view through a cross section of the blade leading edge region with the arrangement of film cooling holes in the present invention. FIG. 6 shows a front view of the film cooling holes on the leading edge region. The blade includes a blade tip 21 and extends to a platform with a fillet 22 forming a transition from the airfoil to the platform. In this particular embodiment, the leading edge is separated into three zones and includes a lower span zone, a middle span zone and an upper span zone. Each of the three zones has around the same spanwise height. The film cooling hole ejection angle is different for each of the three zones with the ejection angle being greater in the lower zone and being the least in the upper zone.

The lower span film cooling holes 31 have an ejection angle of around 30 degrees relative to the airfoil surface. The middle span film cooling holes 32 have an ejection angle of around 25 degrees. The upper span film cooling holes 33 have an ejection angle of around 20 degrees.

The film holes in the lower span have higher ejection angles where the thermal load is low but the mechanical load is high. Higher film cooling ejection angle will yield lower film effectiveness and less convection cooling. A higher angle film cooling hole will yield a higher acute angle corner at the leading edge inner wall where the film hole interface with the blade inner surface. The higher angled film hole will yield a low stress concentration which will be good for the application in the high pull stress loading region of the leading edge. For the blade mid-span region, the heat load is high while the mechanical load is reduced, and thus a shallow angled film hole pattern with a lower ejection angle will be used. This film cooling hole arrangement will yield higher film effectiveness and higher convection cooling. For the blade upper span, the mechanical loading is reduced to a lower level while the heat load is not as high as the mid-span region, and thus a much shallower angled hole with a wider spacing hole can be used for this region in order to tailor the loading conditions.

In FIG. 6, the film cooling holes on the upper span have a longer footprint in the spanwise direction that provides for more film coverage. The upper span film holes 33 have a longer length that provides greater convection cooling distance and are less packed together. The mid-span film holes 32 are more packed together and form a higher density film hole for more film coverage and more convection cooling. The lower span film holes 31 are less packed together and have the shortest length for any of the film holes.

I claim the following:

1. A turbine rotor blade comprising:

an airfoil with a leading edge region;

a pressure side wall and a suction side wall extending from the leading edge region;

a showerhead arrangement of film cooling holes that include a plurality of lower span film cooling holes each with a first ejection angle, a plurality of middle span film cooling holes each with a second ejection angle, and a plurality of upper span film cooling holes each with a third ejection angle;

the lower span film cooling holes having a greater ejection angle than the middle span film cooling holes; and, the middle span film cooling holes having a greater ejection angle than the upper film cooling holes.

2. The turbine rotor blade of claim 1, and further comprising:

the lower span film cooling holes have an ejection angle of around 30 degrees;

the middle span film cooling holes have an ejection angle of around 25 degrees; and, the upper span film cooling holes have an ejection angle of around 20 degrees.

3. The turbine rotor blade of claim 1, and further comprising:

the lower span film cooling holes are formed within a lower zone;

the middle span film cooling hoes are formed within a middle zone;

the upper span film cooling holes are formed within an upper zone; and, the three zones have substantially the same spanwise height.

* * * * *